US006601245B2

(12) United States Patent
Weiss

(10) Patent No.: US 6,601,245 B2
(45) Date of Patent: Aug. 5, 2003

(54) CORROSION RESISTANT RAIL FOR SWIMMING POOL LADDERS AND STEPS

(76) Inventor: Robert Weiss, 20001 SW. 82nd Pl., Miami, FL (US) 33189

( * ) Notice: Subject to any disclaimer, the term of this patent is extended or adjusted under 35 U.S.C. 154(b) by 0 days.

(21) Appl. No.: 10/055,479

(22) Filed: Jan. 22, 2002

(65) Prior Publication Data

US 2002/0133870 A1 Sep. 26, 2002

Related U.S. Application Data

(63) Continuation-in-part of application No. 09/556,043, filed on Apr. 21, 2000, now abandoned.

(51) Int. Cl.[7] ..... E04H 4/06
(52) U.S. Cl. ..... 4/496; 182/106; 256/59
(58) Field of Search ..... 4/494, 496; 256/59; 182/93, 106; 264/339

(56) References Cited

U.S. PATENT DOCUMENTS 3,787,033 A * 1/1974 Snyder et al. ..... 256/59
4,892,292 A * 1/1990 Russell ..... 256/66
4,930,754 A * 6/1990 Caron et al. ..... 256/65.05
4,953,830 A * 9/1990 Weaver, III ..... 256/59 X

OTHER PUBLICATIONS

KDI Paragon., "Quality Swimming Pool Equipment", pp. 1, 2, 12 and 13.*

* cited by examiner

*Primary Examiner*—Robert M. Fetsuga
(74) *Attorney, Agent, or Firm*—Robert M. Downey, P.A.

(57) ABSTRACT

A handrail is defined by a main tubular body formed of a non-corrosive, rigid vinyl material. The handrail includes a first open end, a second open end and a mid-section extending therebetween, with at least one curved portion formed along the mid-section. One or more rigid inserts are fitted within a hollow interior of the handrail for providing rigidity and strength and for reducing bending and flexing of the handrail when a load is applied thereto. The opposite first and second open ends of the handrail are covered with caps to provide a watertight seal which prevents moisture from entering the hollow interior. The rigid inserts may also be capped at opposite ends to protect against corrosion.

6 Claims, 7 Drawing Sheets

CORROSION RESISTANT RAIL FOR SWIMMING POOL LADDERS AND STEPS

This application is a continuation-in-part application of co-pending patent application Ser. No. 09/556,043, filed on Apr. 21, 2000, abandoned.

BACKGROUND OF THE INVENTION

1. Field of the Invention

The present invention is directed to non-corrosive rail structures and, more particularly, to a hollow tubular rail formed of a rigid vinyl material, such as PVC, for swimming pool ladders and steps and including reinforcing means within the hollow interior for preventing excessive bending, flexing or deformities of the rail when under load.

2. Discussion of the Related Art

Rails for swimming pool ladders and steps are typically made of aluminum or metal alloy compositions which are subject to corrosion. Over time, exposure to moisture, ultraviolet light and harsh chemicals may cause corrosion or discoloration of the rail, leaving an unpleasant appearance. Some of the rust and discoloration can be removed from aluminum and metal alloy pool rails with the use of metal polishing agents. However, use of such chemical agents can sometimes remove a protective outer coating on the pool rail which further exposes the rail surface to future corrosion and discoloration. Once any protective coatings are removed, continual and regular maintenance is required to maintain a clean and pleasant appearance.

It is well know to cover the surface of metal tubes and handrails with a protective sleeve or non-corrosive coating. Examples of such protective rail coverings can be seen in the U.S. Patents to Shaw, U.S. Pat. No. 4,985,942; and Watase, U.S. Pat. No. 4,071,048. In this instance, the rail structure itself is still formed of a corrosive material. Thus, if moisture becomes trapped between the protective covering and the metal rail, the rail will slowly corrode. This is particularly true in the instance of a removable sleeve or cover, such as the type shown in the patent to Shaw, which fails to provide a watertight seal against moisture entering between the protective wrap and the metal rail surface. Further, handrail wraps of this type may often only cover a portion of the rail length, thereby leaving other metal surfaces exposed.

Coatings on metal rails, such as that disclosed in the patent to Watase, can become scratched, thereby exposing the underlying metal surface to corrosion. Further, coating an entire metal handrail with a suitable, non-corrosive and UV resistant material which would be suitable for swimming pool environments is a costly process. Accordingly, the resultant product is considerably expensive and not affordable to most homeowners. Additionally, a coated metal handrail is considerably heavy and difficult to maintain anchored in fixed position.

SUMMARY OF THE INVENTION

The present invention is directed to a non-corrosive rail assembly for swimming pools and spas. The rail assembly includes one or more handrails, each of which is defined by a main tubular body formed of a non-corrosive, rigid vinyl material. The handrail includes a first open end, a second open end and a mid-section extending therebetween, with at least one curved portion formed along the mid-section. One or more rigid inserts are fitted within a hollow interior of the handrail for providing rigidity and strength and for reducing bending and flexing of the handrail when a load is applied thereto. The opposite first and second open ends of the handrail are covered with caps to provide a watertight seal which prevents moisture from entering the hollow interior. The rigid inserts may also be capped at opposite ends to protect against corrosion.

OBJECTS AND ADVANTAGES OF THE INVENTION

It is a primary object of the present invention to provide a non-corrosive rail for swimming pool and spa ladders and steps which is rigid and which does not bend, flex, or deform excessively when under load.

It is a further object of the present invention to provide a non-corrosive rail for swimming pool and spa ladders and steps which is easy to clean and always stays cool to the touch.

It is still a further object of the present invention to provide a rail for swimming pool and spa ladders and steps which does not rust, pit, discolor or require use of polishes, paint or other harsh chemicals for maintenance.

It is still a further object of the present invention to provide a non-corrosive rail for swimming pool and spa ladders and steps which is formed of a non-conducting material and which does not require electrical grounding.

It is yet a further object of the present invention to provide a non-corrosive rail for swimming pool and spa ladders and steps which is resistant to ultraviolet light and which will not discolor, corrode or deform when exposed to ultraviolet radiation.

It is still a further object of the present invention to provide a non-corrosive rail for swimming pool and spa ladders and steps which is resistant to exposure to pool chemicals, including acid and chlorine.

These and other objects and advantages of the present invention are more readily apparent with reference to the following detailed description and the accompanying drawings.

BRIEF DESCRIPTION OF THE DRAWINGS

For a fuller understanding of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Referring to FIGS. 1–8, several embodiments of the Corrosion Resistant Rail of the present invention are shown, wherein the rail assembly is generally indicated as 10.

Figure 1:
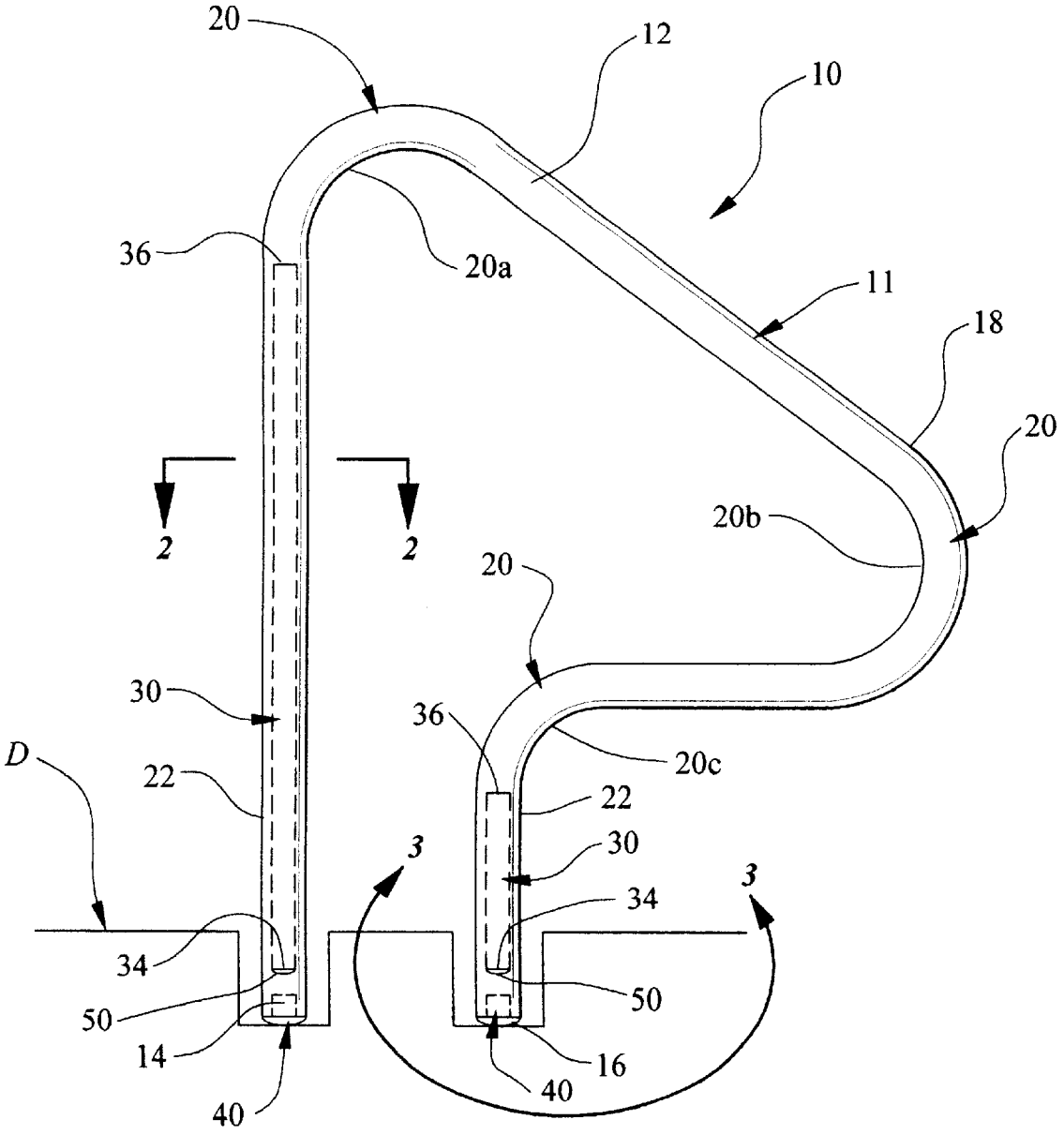
FIG. 1 is a side elevational view of a rail of the present invention, in accordance with a first embodiment thereof, wherein the rail is shown installed in a deck adjacent a swimming pool or spa.
Figure 4:
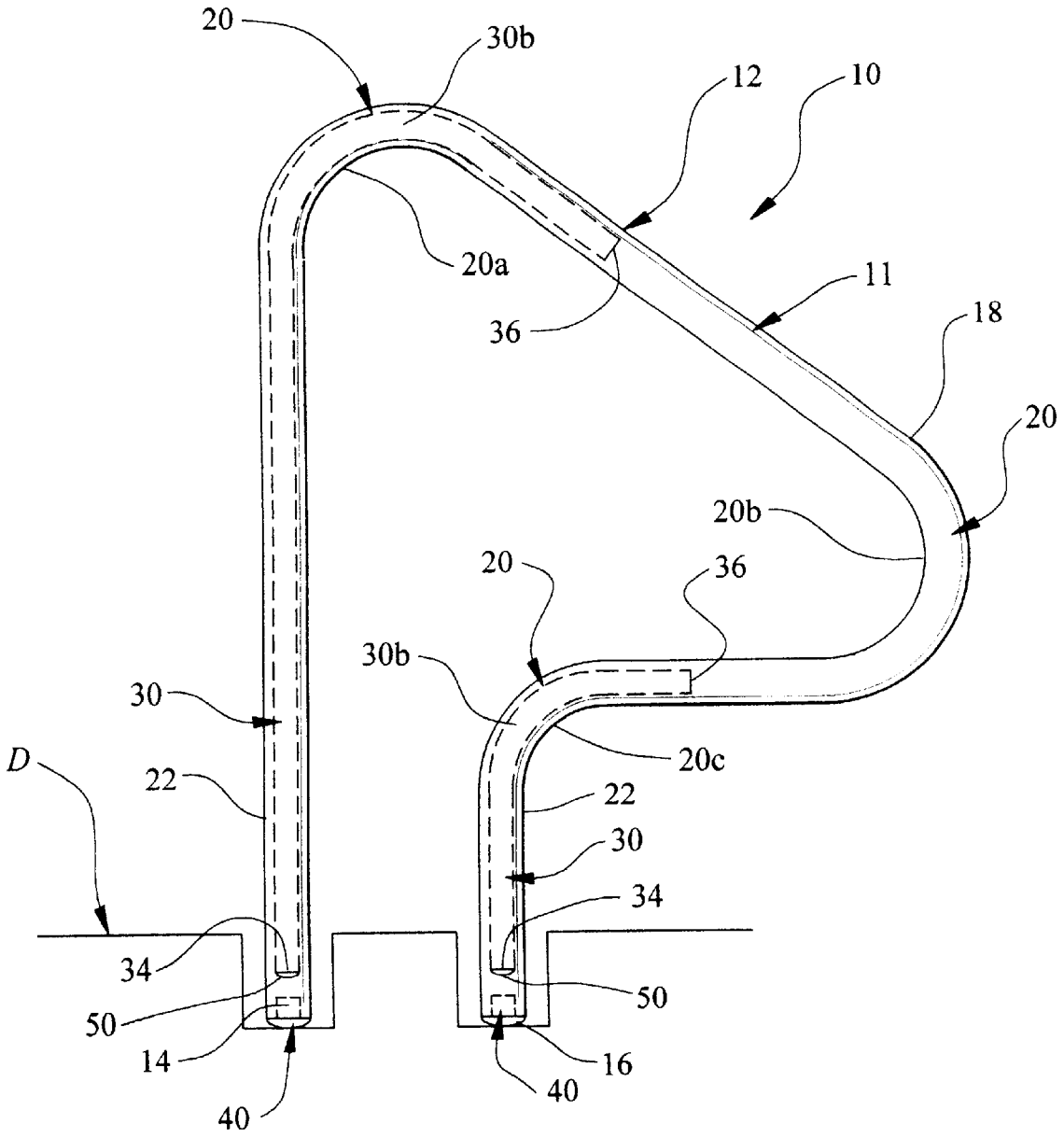
FIG. 4 is a side elevational view illustrating a variation of the embodiment of FIG. 1, wherein rigid reinforcing inserts extend through curved portions of the handrail.
Figure 5:
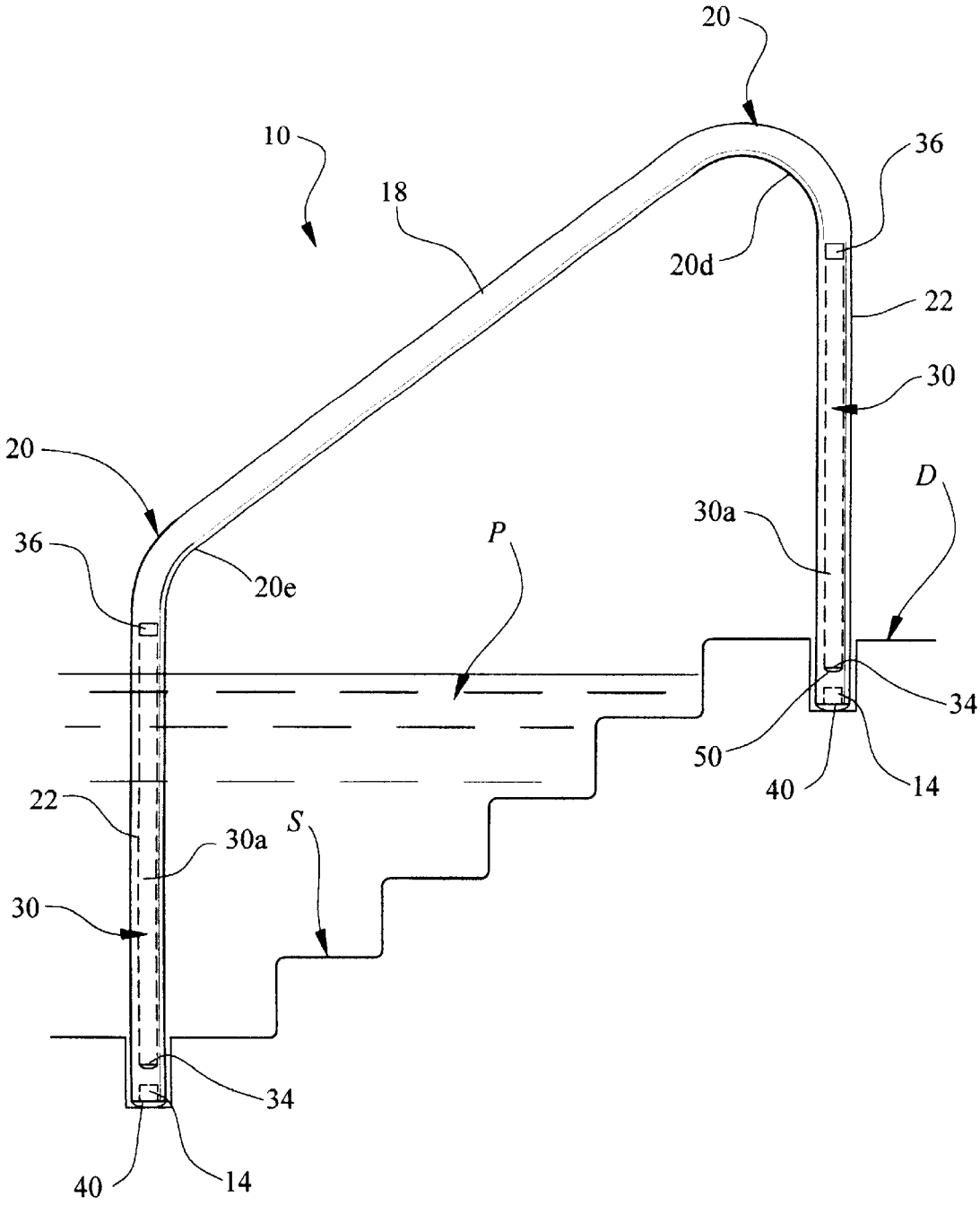
FIG. 5 is a side elevational view of a second embodiment of the handrail of the present invention, wherein the handrail is shown installed in the steps of a swimming pool or spa.
Figure 6:
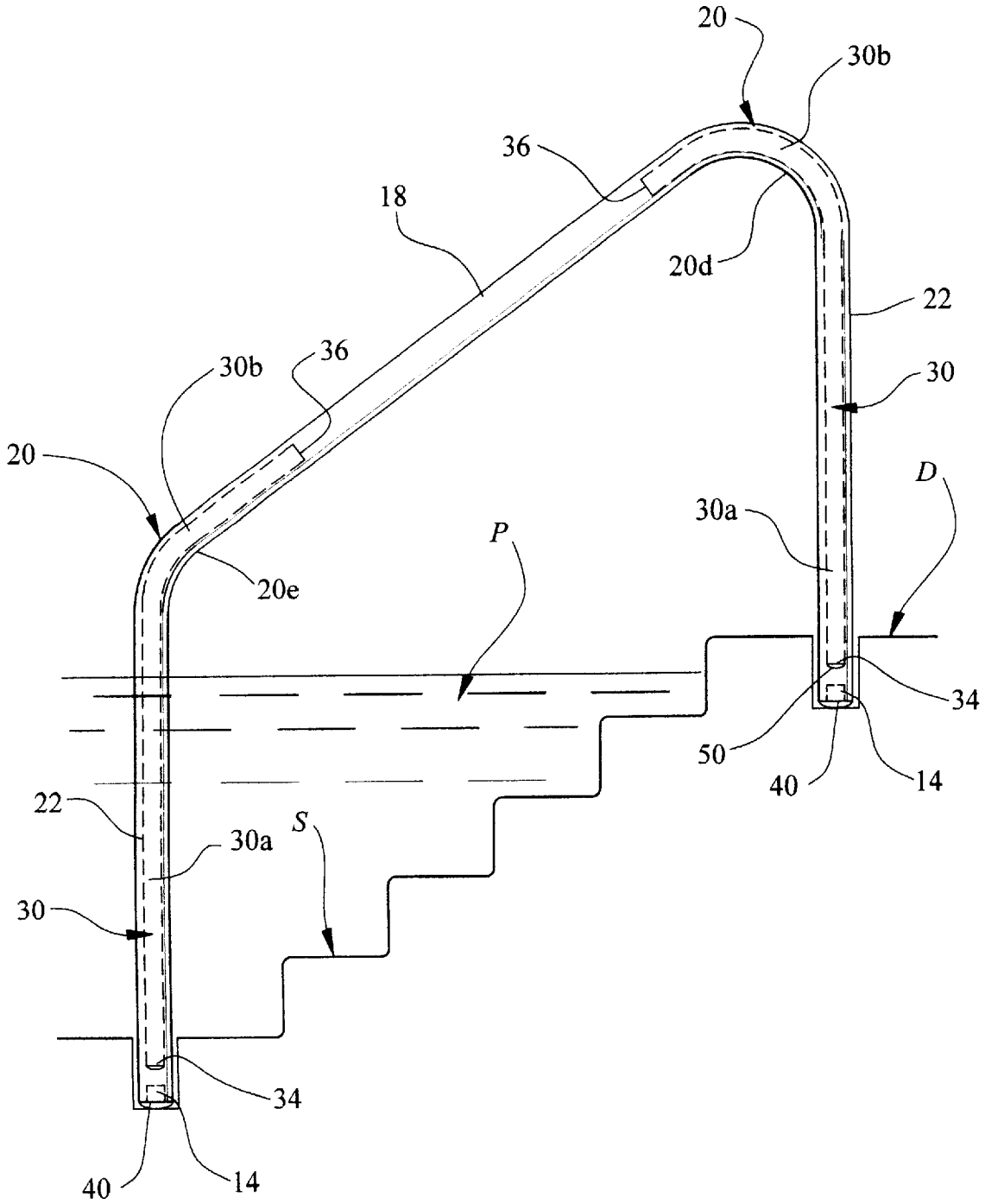
FIG. 6 is a side elevational view showing a variation of the embodiment of FIG. 5.

In FIGS. 1 and 4, the rail assembly 10 is shown in accordance with one embodiment, wherein a handrail is formed and configured for mounting within the deck D adjacent the edge and steps of a swimming pool or spa. In FIGS. 5 and 6, the handrail 11 is formed and configured for installation within a swimming pool or spa, at the base and top of steps S within the pool or spa P. Finally, in FIGS. 7 and 8, the handrail 11 is shown formed and configured as part of an assembly of a ladder L which mounts to a deck D and extends into a swimming pool P.

In each of the embodiments, the handrail 11 is defined by a main tubular body 12 formed of a non-corrosive, rigid vinyl material such as poly vinyl chloride (PVC). The handrail 11 is specifically intended to assist a person when entering or exiting a swimming pool or spa P at a ladder L or steps S. In manufacture, the tubular body 12 of the handrail 11 is subjected to heat at sufficient temperatures to permit bending and forming of the tubular body 12 to the desired configuration while at the same time, permitting insertion of rigid pipe sections, as described hereinafter. The process of forming a tubular body of rigid vinyl material, such as PVC, is well known in the art.

Figure 7:
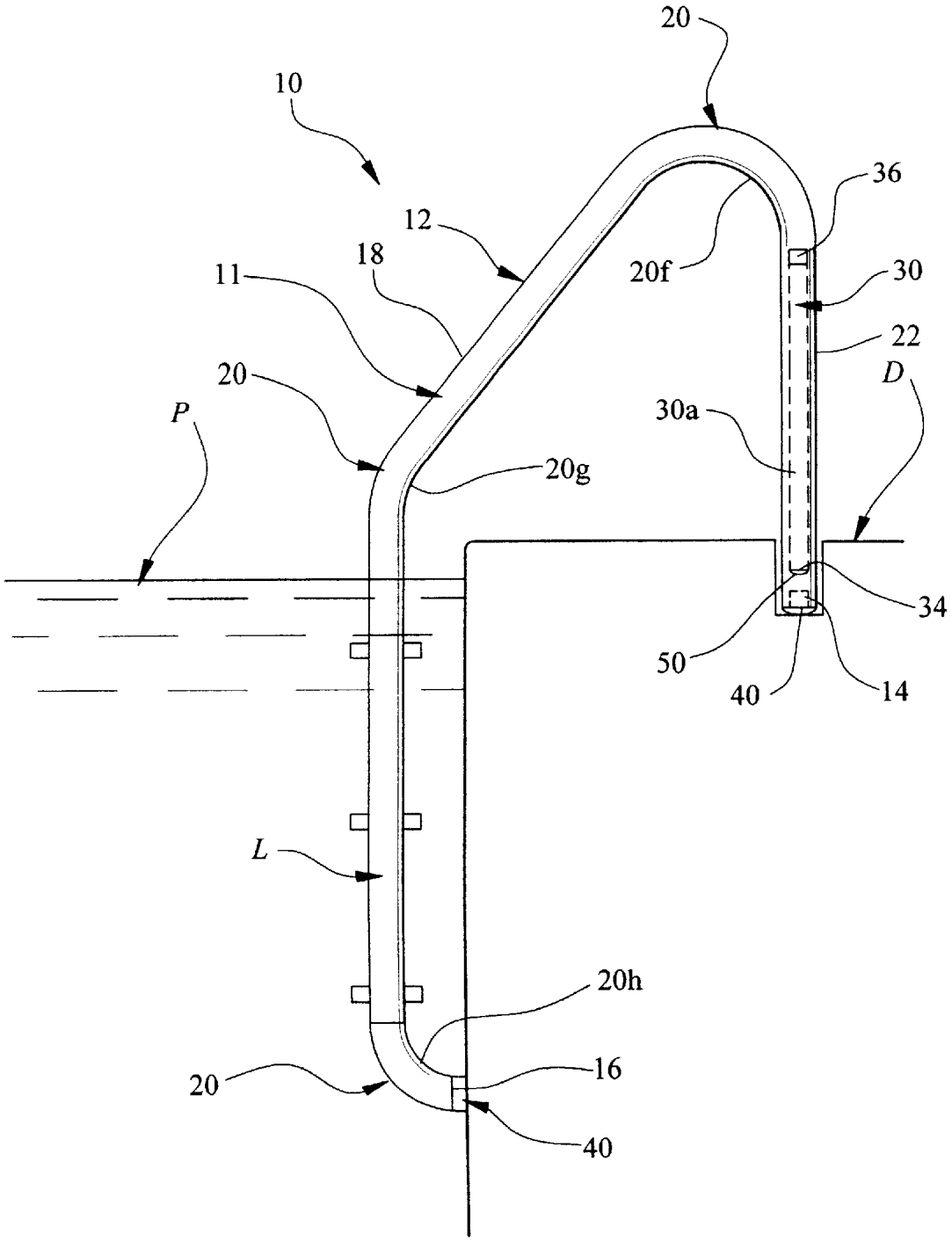
FIG. 7 is a side elevational view of a third embodiment of the rail of the present invention shown installed as part of a ladder in a swimming pool.
Figure 8:
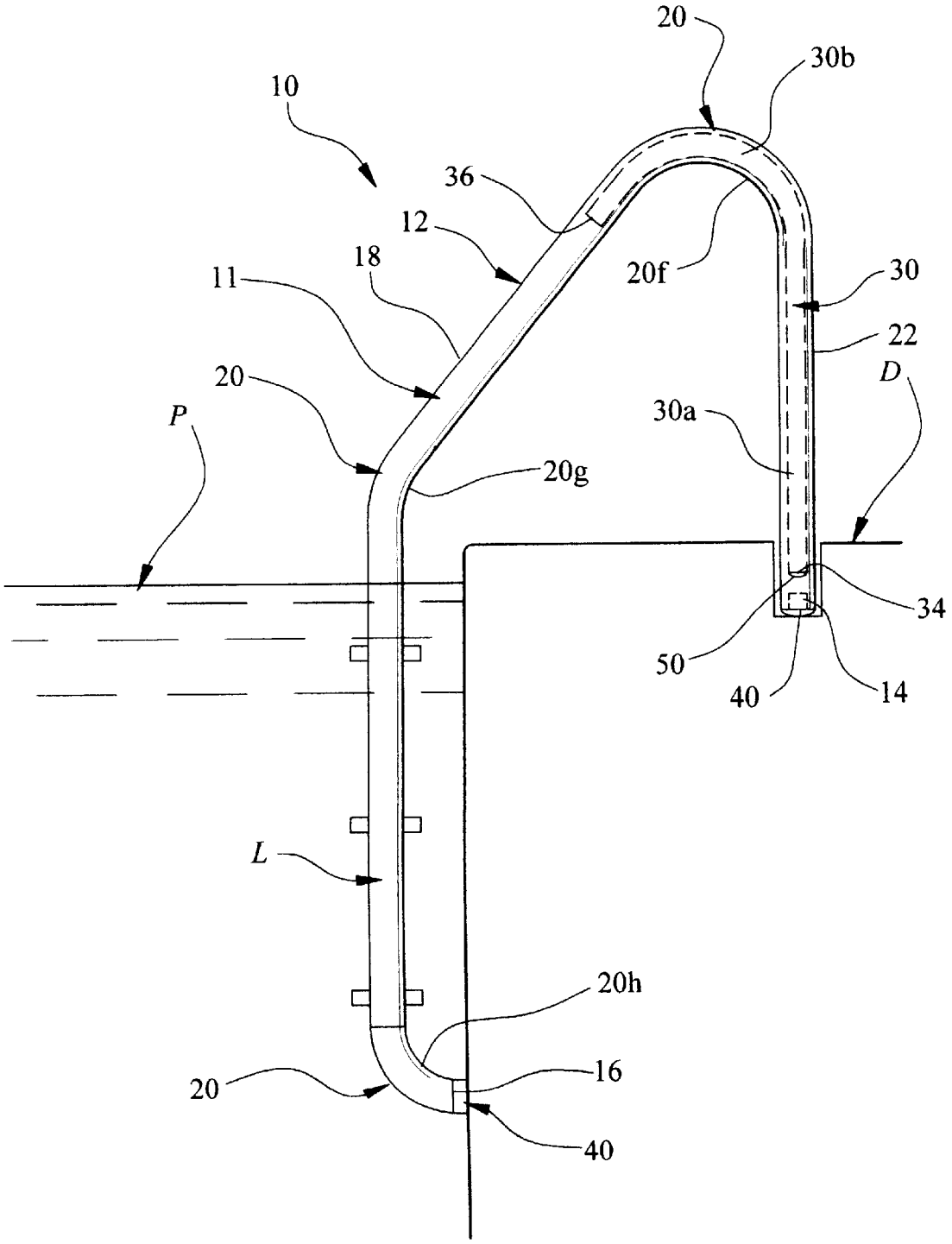
FIG. 8 is a side elevational view showing a variation of the embodiment of FIG. 7.

Prior to forming, the tubular body 12 is cut to the desired size from an extruded tubular form of equal or greater length. The tubular body 12, cut to the desired size, includes a first open end 14 and a second open end 16. The length of the tubular body 12 is defined by the mid-section 18 extending between the opposite ends 14, 16. When formed to the desired configuration, the tubular body 12 of the handrail 11 includes at least one curved portion 20 and one or two vertical leg members 22. In the embodiment shown in FIGS. 1 and 4, the formed handrail 11 includes curved portions 20*a,* 20*b* and 20*c*. In the embodiment of FIGS. 5 and 6, the formed handrail 11 includes curved portions 20*d* and 20*e*. In the embodiment of FIGS. 7 and 8, the formed handrail 11 of the ladder L includes curved portions 20*f,* 20*g* and 20*h*.

In each of the embodiments shown throughout FIGS. 1–8, the handrail 11 is fitted with reinforcing means within a hollow interior 24 of the tubular body 12. The reinforcing means serves the purpose of providing rigidity and strength to the handrail 11 in order to reduce bending and flexing of the handrail when a load is applied thereto. More specifically, the composition of the rigid vinyl material causes the handrail 11 to flex or bend at one or more of the curved portions 20 when a person entering or exiting the swimming pool applies weight to the handrail 11. The reinforcing means serves to reduce the amount of flexing or bending at the curved portions 20 when a person's weight, or other force, is applied to the handrail 11, thereby providing increased strength, rigidity and stability to the handrail assembly 10.

In a preferred embodiment, the reinforcing means is defined by one or more rigid pipe sections 30. Each of the rigid pipe sections 30 may have a straight portion 30*a,* as seen in FIGS. 1, 5 and 7. Alternatively, the pipe sections 30 may be formed to include both a straight portion 30*a* and a curved portion 30*b* which, together, conform with the configuration of the handrail 11, and particularly a curved portion 20 and a vertical leg member 22. The rigid pipe sections 30 may be formed of galvanized steel or other suitable rigid materials which preferably are resistant to corrosion.

Figure 3:
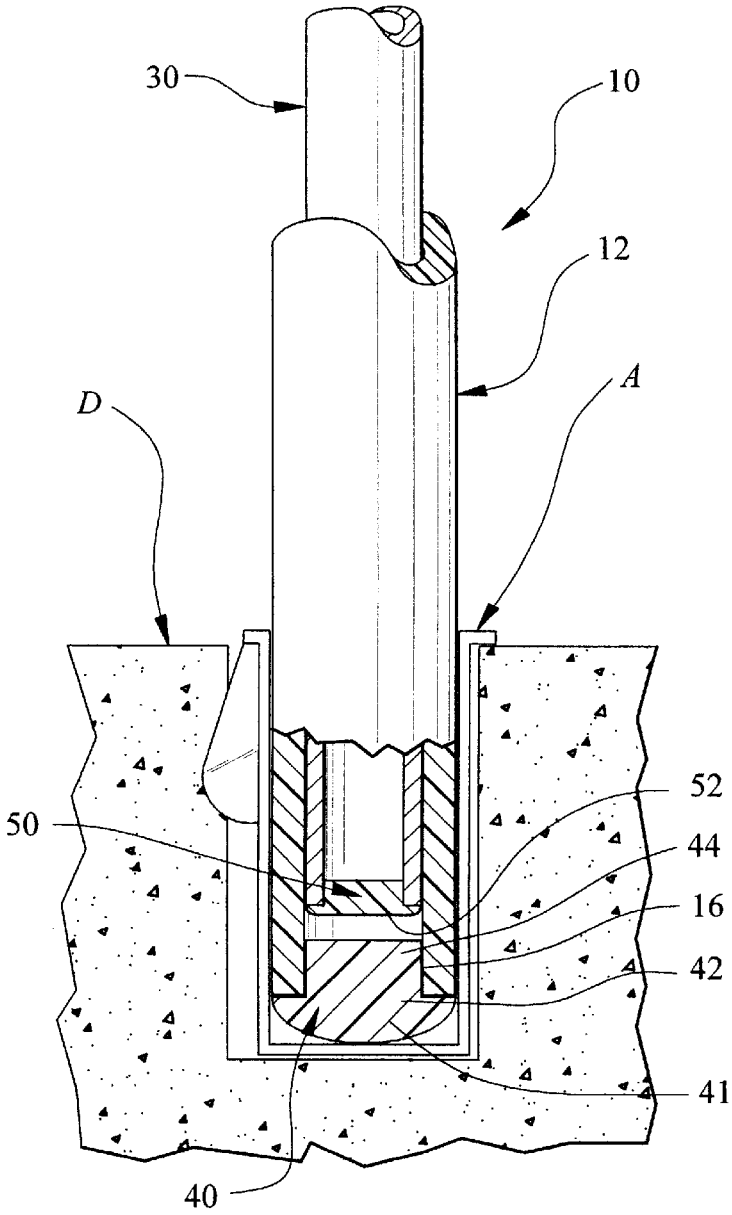
FIG. 3 is an isolated cutaway, in partial section, taken from the area indicated as 3 in FIG. 1.
Figure 2:
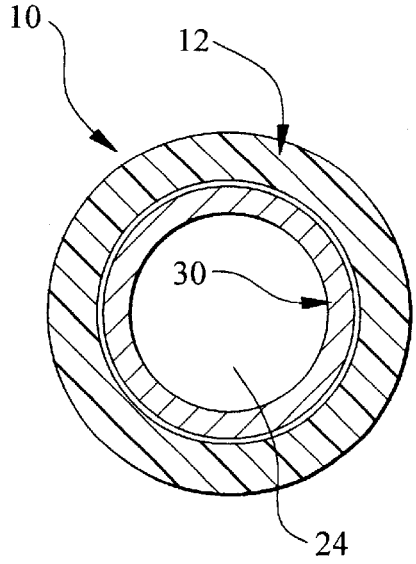
FIG. 2 is a cross-section taken along the plane of the line 2—2 of FIG. 1.

In order to maintain the hollow interior 24 of the handrail tubular body 12 moisture tight and airtight, cap means 40 are provided for attachment to the first and second open ends 14, 16. In a preferred embodiment, the cap means 40 are defined by caps 41 each having an enlarged head 42 and a neck 44 which extends through the respective open ends 14, 16 of the tubular body, in snug-fitted relation against an inner wall surface of the tubular body. It is preferred that the caps 41 be formed of the same non-corrosive, rigid vinyl material as the tubular body 12. However, other non-corrosive materials may be used. The caps 41 are secured by friction fit within the hollow interior of the open ends 14, 16. Further, suitable adhesives or glues may be used for providing a moisture tight and airtight seal between the caps 41 and the open ends 14, 16 of the tubular body 12. Maintaining a moisture tight and airtight seal at the open ends 14, 16, prevents moisture from contacting the rigid pipe sections 30, thereby preventing corrosion and deterioration of the pipe sections 30. To further prevent corrosion of the pipe sections 30, caps 50 may be fitted to one or both ends of the pipe sections 30, as seen in FIG. 3. The caps 50 provide an added barrier of protection between the pipe sections 30 and the cap means 40. The caps 50 are specifically sized and configured to fit within the hollow ends of the pipe sections 30, and cover the exposed ends of the pipe sections 30. More specifically, the caps 50 include an enlarged head which has an outer diameter approximately equal to the inner diameter of the hollow interior 24 of the tubular body 12 of the handrail 11.

The rigid pipe sections 30 are inserted within the hollow interior 24 of the tubular body 12 by heating the tubular body 12 to a sufficient temperature to permit flexing and deforming of the tubular body. The tubular body 12 may further be stretched, by use of air pressure injected into the hollow interior 24 or by insertion of spreading elements within the hollow interior 24. The opposite open ends 14, 16 are slipped over the exterior of the rigid pipe inserts 30 as the rigid pipe inserts are advanced through the hollow interior 24. Under heat, the tubular body 12 is deformable to permit passage of the tubular body 12 about the curved sections 30*b* of the pipe sections 30 as the tubular body is moved over the pipe sections 30 to cause the pipe sections 30 to be received into position within the hollow interior 24. It is important to note that when properly positioned, the pipe sections 30 are spaced from the opposite open ends 14, 16 of the main tubular body. More specifically, the rigid pipe sections 30 include first ends 34 which are spaced from the respective open ends 14, 16 of the tubular body 12. An opposite second end 36 of the rigid pipe sections 30 terminates within the hollow interior 24 in spaced relation from the opposite ends 14, 16. In this manner, the rigid pipe insert sections 30 are entirely received within the hollow interior 24 so that the opposite ends 34, 36 are concealed in spaced relation from the opposite ends 14, 16.

While the invention has been shown and described in accordance with practical and preferred embodiments thereof, it is recognized that departures from the instant disclosure are contemplated within the spirit and scope of the invention as defined in the following claims under the doctrine of equivalents. Now the invention as been described:

What is claimed:

1. An assembly for swimming pool ladders and steps comprising:

a main tubular body defining a handrail and formed of a non-corrosive, rigid vinyl material, said handrail including a first open end, a second open end, and a mid-section extending between said first and second open ends, said mid-section including at least one curved portion, and said handrail having a hollow interior;

cap means fitted to said first and second open ends of said handrail in covering relation thereto for maintaining said hollow interior of said handrail moisture tight and airtight; and at least one rigid insert received within said hollow interior of said handrail and including a first end terminating within said hollow interior in spaced relation to said first open end of said handrail, and an opposite second end terminating within said hollow interior in spaced relation from said second open end of said handrail, said at least one rigid insert extending through said at least one curved portion of said handrail, and said at least one rigid insert being structured and disposed to provide rigidity and strength to said handrail and to reduce bending and flexing of said handrail when a load is applied thereto.

2. The assembly as recited in claim 1 comprising a plurality of said rigid inserts received within said hollow interior of said handrail.

3. The assembly as recited in claim 1 wherein said mid-section of said handrail includes a plurality of curved portions.

4. An assembly for swimming pool ladders and steps comprising:

a main tubular body defining a handrail and formed of a non-corrosive, rigid vinyl material, said handrail including a first open end, a second open end, and a mid-section extending between said first and second open ends, said mid-section including at least one curved portion, and said handrail having a hollow interior;

cap means fitted to said first and second open ends of said handrail in covering relation thereto for maintaining said hollow interior of said handrail moisture tight and airtight;

at least one rigid insert received within said hollow interior of said handrail and including a first end terminating within said hollow interior in spaced relation to said first open end of said handrail, and an opposite second end terminating within said hollow interior in spaced relation from said second open end of said handrail, said at least one rigid insert being structured and disposed to provide rigidity and strength to said handrail and to reduce bending and flexing of said handrail when a load is applied thereto; and second cap means fitted to said first and second opposite ends of said at least one rigid insert for protecting said at least one rigid insert from corrosion.

5. The assembly as recited in claim 4 comprising a plurality of said rigid inserts received within said hollow interior of said handrail.

6. The assembly as recited in claim 4 wherein said mid-section of said handrail includes a plurality of curved portions.

* * * * *